US007396149B2

(12) United States Patent
Dicken

(10) Patent No.: US 7,396,149 B2
(45) Date of Patent: Jul. 8, 2008

(54) CEILING COMPRISING ADJACENT LUMINATES AND METHOD FOR MOUNTING SUCH CEILING

(75) Inventor: Norbert Dicken, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 476 days.

(21) Appl. No.: 10/504,660

(22) PCT Filed: Feb. 5, 2003

(86) PCT No.: PCT/IB03/00520

§ 371 (c)(1),
(2), (4) Date: Aug. 13, 2004

(87) PCT Pub. No.: WO03/071187

PCT Pub. Date: Aug. 28, 2003

(65) Prior Publication Data

US 2005/0166505 A1 Aug. 4, 2005

(30) Foreign Application Priority Data

Feb. 21, 2002 (EP) ..... 02075660
Oct. 16, 2002 (EP) ..... 02079274

(51) Int. Cl.
*F21S 8/06* (2006.01)

(52) U.S. Cl. ..... 362/404; 362/150; 362/219; 248/343

(58) Field of Classification Search ..... 362/150, 362/365, 404, 149, 148, 406, 407, 408, 219, 362/147; 248/317, 343, 220.21, 222.12, 248/222.14

See application file for complete search history.

(56) References Cited

U.S. PATENT DOCUMENTS

| | | | | | |
|---|---|---|---|---|---|
| 2,338,077 | A | * | 12/1943 | Scribner | 362/218 |
| 2,383,007 | A | * | 8/1945 | Maurette | 362/457 |
| 2,632,620 | A | * | 3/1953 | Hurley | 248/343 |
| 3,101,178 | A | * | 8/1963 | Young | 362/404 |
| 3,154,001 | A | * | 10/1964 | Zurawski | 454/354 |
| 3,377,488 | A | * | 4/1968 | Lorenzo | 307/157 |
| 4,726,781 | A | * | 2/1988 | Bernhart et al. | 439/228 |
| 4,856,216 | A | * | 8/1989 | Gross | 40/559 |
| 5,025,355 | A | * | 6/1991 | Harwood | 362/147 |
| 5,184,881 | A | * | 2/1993 | Karpen | 362/1 |
| 5,658,066 | A | * | 8/1997 | Hirsch | 362/219 |
| 6,508,567 | B1 | * | 1/2003 | Fiene | 362/147 |

FOREIGN PATENT DOCUMENTS

GB 660465 11/1951

* cited by examiner

*Primary Examiner*—Sandra L. O'Shea
*Assistant Examiner*—Gunyoung T. Lee

(57) ABSTRACT

Ceiling comprising adjacent luminaries (1), whereby a luminaries (1) is fixed by at least two separate fixation means. The fixation means comprising only one suspension member (2,3) connected to the center of the upper side (6) of the luminaries (1). Furthermore, there is at least one fixation member (22) connecting the luminaries (1) to an adjacent luminaries (1). The lower sides (10) of the luminaries (1) form a substantial flat surface of the ceiling.

17 Claims, 3 Drawing Sheets

CEILING COMPRISING ADJACENT LUMINATES AND METHOD FOR MOUNTING SUCH CEILING

The invention is related to a system comprising a number of adjacent suspending luminaires, whereby a luminaire is fixed by at least two separate fixation means. The lower sides of the luminaires may form a substantial flat surface of at least a portion of the ceiling. Such system can be used for lightening a room inside a building, for example a showroom, but it can also be used outdoor, for example to lighten the area of a petrol station or other area where a bright lightening is required.

In general, such luminaire comprises a housing having a rectangular shape, seen from below, the rectangle having sides of more than one meter. The housing may enclose a lamp or a number of lamps, a light reflecting surface behind the lamps, and a light distributing diffuser plate in front of the lamps.

For safety reasons a reliable fixation of the luminaires is required and therefore it is usual to fix a luminaire by at least two suspension members, for example steel wires. Thereby both suspension members should be able to carry the whole luminaire, so that at each location where the suspension member is attached the housing of the luminaire, the housing must be reinforced. Furthermore, each of the suspension members must have an exact predetermined length to provide for a correct position of the luminaire.

The object of the invention is to provide an efficient and reliable fixation of luminaires in a lightening ceiling.

In order to accomplish that objective, the fixation means comprise only one suspension member connected to the center of the upper side of the luminaire for fixation to a ceiling and at least one fixation member connecting the luminaire to at least one adjacent luminaire. By interconnecting two adjacent luminaires by fixation members, whereby each of the luminaires is attached to a suspension member, each luminaire is fixed at least by two separate fixation means. Thereby a reliable fixation is achieved by making each fixation means sufficient strong to carry the luminaire. In case one of the fixation means is damaged, the other fixation means will still carry the luminaire.

Preferably, the lower sides of the luminaires form a substantial flat surface of a lighting ceiling. Thereby the luminaires may dovetail mutually to form a closed and smooth surface of the lighting ceiling or portion of a ceiling.

In one preferred embodiment a luminaire has a substantial vertical straight side wall facing a similar side wall of an adjacent luminaire, said side walls being interconnected by said fixation member. Thereby the fixation member may comprise one or more screw bolts extending through holes in the housings of both luminaires.

In one preferred embodiment two adjacent luminaires are interconnected by a fixation member located between the two luminaires, said fixation member comprising portions seizing both luminaires and said fixation member being operable from above the interconnected luminaires. Thereby the luminaires can have a closed housing and it is not necessary to open that housing during installation of the luminaires. The fixation member remain outside that housing. The said portions of the said fixation member may cooperate with grooves in the side walls of the housing of the luminaire. Because the fixation member is operable from above, the fixation member does not disturb the flat and smooth surface of the ceiling.

Preferably, two adjacent luminaires are interconnected by two fixation members at two locations at a distance from each other. In order to achieve a more reliable fixation of the luminaires, an additional fixation through said fixation members is preferable over an additional suspension member, because the fixation members for interconnecting two luminaires is more simple then the construction of a suspension member.

Preferably, four luminaires are interconnected by fixation members, whereby each of the four luminaires is connected to two other luminaires of the said four luminaires. Thereby a stable construction is achieved, comprising four suspension members positioned at the corners of a rectangle.

In one preferred embodiment the lower surface of a luminaire is part of a dust-tight box having a lower wall—forming said surface of the ceiling—and an upper wall at a distance from the lower wall, said box being located inside the housing of the luminaire, and underneath the lamp of the luminaire. The lower wall of the luminaire is a diffuser plate distributing the light equally over the lower surface of the luminaire. However, dirt particles laying on such diffuser plate can be seen from below as dark dots. Therefore it is advantageously to have a dust free area above the diffuser plate. When such area is a dust-tight box, the housing of the luminaire can be opened during installation of the luminaires without the risk that dirt particles can reach the diffuser plate. Preferably, said box can be removed completely out of the housing of the luminaire, so that the housings of adjacent luminaires can be easily fixed to each other by fixation members during installation of the luminaires.

In one preferred embodiment the suspension member comprises a wire and/or a height adjustable member. When suspending the luminaire by means of a wire, for example a steel wire, the length of the wire defines the position of the luminaire. In case the luminaire is suspended by only one wire, the position of the edge of the luminaire can be adjusted to the position of the edge of the adjacent luminaire. By making use of the height adjustable member, i.e. a member varying the length of the suspending member, the position (i.e. the height) of the luminaire can be adjusted after the luminaire is connected by one or more fixation members to an adjacent luminaire.

Preferably, each luminaire comprises a number of tube-like fluorescent lamps being positioned parallel with respect to each other. There may be a number of lamps in the same horizontal plane and there may be lamps located above each other.

The invention furthermore relates to a ceiling or wall at least partly created by a system according to any of said embodiments.

The invention furthermore relates to a method for mounting adjacent luminaires to form a light ceiling, whereby a luminaire is fixed by at least two separate fixation means, and whereby a luminaire is suspended at only one suspension member connected to the center of the upper side of the luminaire, and whereby the luminaire is connected by at least one fixation member to an adjacent suspending luminaire.

The invention is also related to a luminaire for use in a ceiling method and/or system as described above, whereby the housing of the luminaire comprises only one connecting element for suspending the luminaire by a suspension member, the connecting element being located in the center of the upper side of the housing of the luminaire, and whereby the housing is provided with means for fixing the luminaire to an adjacent luminaire. Such means may be grooves or holes in the side walls of the housing of the luminaire.

The invention will be further explained hereinafter by means of a description of an embodiment of a luminaire and means for fixing luminaires, in which reference is made to a drawing, in which.

The Figures are merely schematic representations of the embodiment, in which less relevant parts are not shown.

Figure 1:
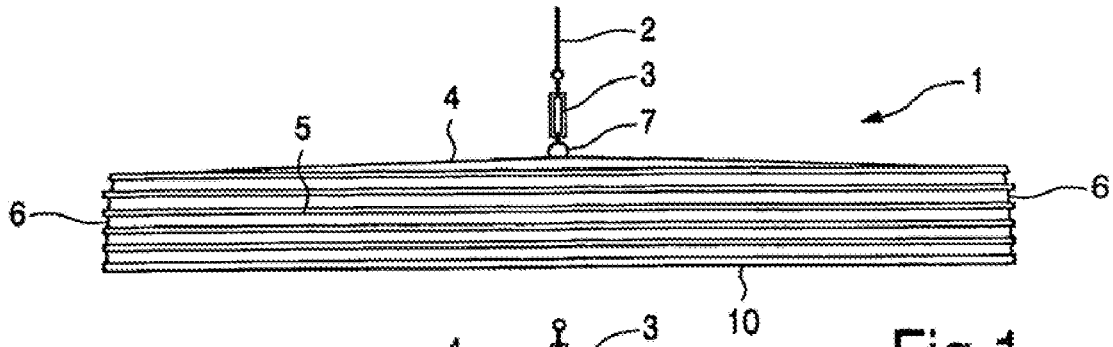
FIG. 1 is a side view of a luminaire.

FIG. 1 shows a luminaire 1 suspending by means of a suspension member including a steel wire 2 and a height adjustable member 3. The suspension member 2,3 is attached to the luminaire 1 through a connecting element 7 in the center of the upper wall 4 of the housing 5 of the luminaire.

The aluminum housing 5 of the luminaire 1 is provided with a profile forming horizontal grooves 6 in the side walls of the housing 5. The housing 5 comprises lamps, light reflecting surfaces and light distributing and diffusing means.

The lower surface of the luminaire 1 is a diffuser plate 10. The diffuser plate 10 is a part of a dust-tight box 11 (also called a light-box) which can be removed out of the housing 5, as is shown in FIG. 3.

Figure 2:
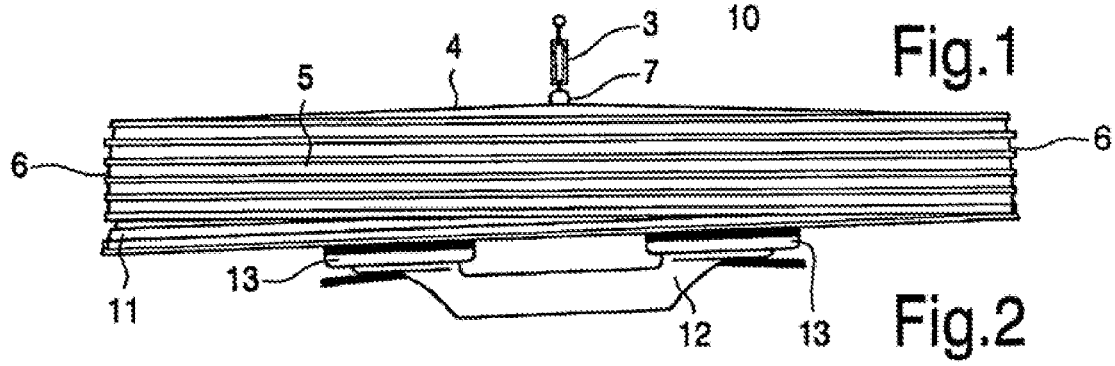
FIG. 2 shows how to open the luminaire.

FIG. 2 shows the removal of the dust-tight box 11 from the housing 5. A device 12 provided with a number of suction cups 13 is attached to the diffuser plate 10 after which the diffuser plate 10, and therewith the box 11, can be pulled downwardly out of the housing 5, whereby resilient clamps (not shown) in the housing release the box.

Figure 3:
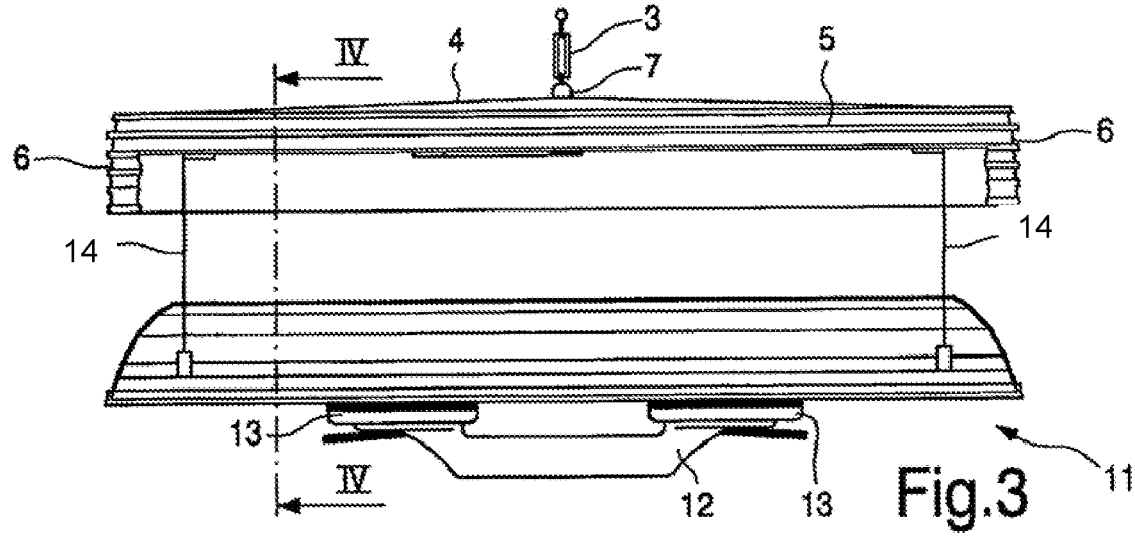
FIG. 3 shows an opened luminaire.

FIG. 3 shows the dust-tight box 11 suspending underneath the housing 5 through steel wires 14, whereby a portion of the side wall of the housing 5 is left out to show the steel wires. The steel wires 14 are spring loaded, so that the weight of the box 11 is partly compensated facilitating the handling of the dust-tight box 11.

Figure 4:
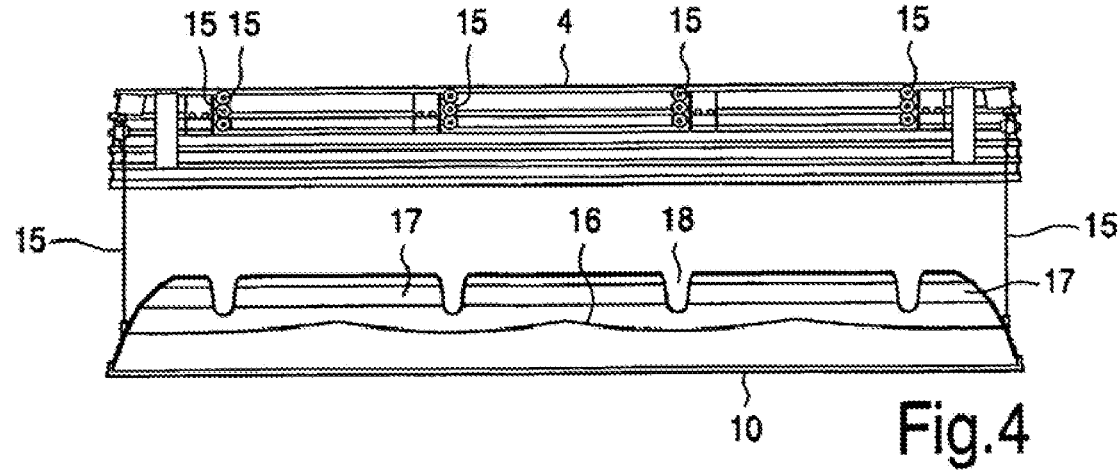
FIG. 4 is a sectional view along the line IV-IV in FIG. 3.

FIG. 4 shows the housing 5 and the dust-tight box 11 in a sectional view. In the housing 5, four groups of three tube-like fluorescent lamps 15 are present. Each group includes three lamps above each other, which lamps may have different colors. The lamp holders are mounted in the housing 5 of the luminaire 1, so that the lamps stay in the housing 5 when the dust-tight box 11 is removed.

As shown in FIG. 4, the lower wall of the dust-tight box 11 is the diffuser plate 10 and the upper wall is a light curtain plate 16 having a varying transparency. The light curtain plate 16 is furthermore not flat, but curved around the lamps 15. The reflector surface 17 is attached to the dust-tight box 11, which reflector surface 17 having recesses 18 for accommodating the lamps 15 when the luminaire 1 is assembled.

Figure 5:
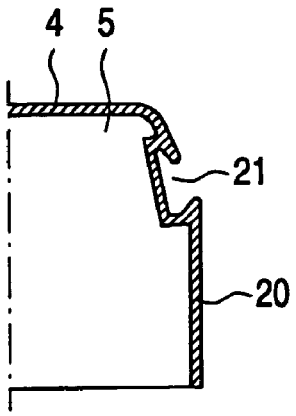
FIG. 5 is a sectional view of a portion of the housing of a luminaire.

FIG. 5 is a sectional view of a portion of the housing 5 showing a side wall 20 of the housing. The side wall 20 may have a profile with a number of grooves, as shown in FIGS. 1-4, but in FIG. 5 only one groove 21 is present.

Figure 6:
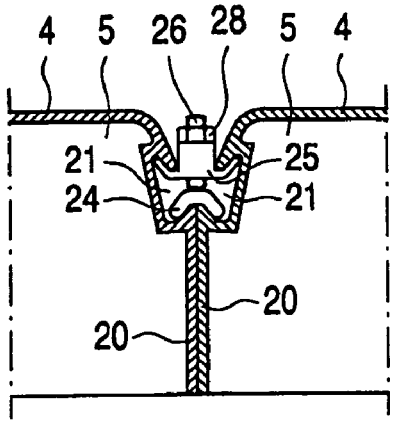
FIG. 6 shows the interconnection of the housings of two luminaires.

FIG. 6 shows portions of two adjacent housings 5 abutting each other, so that the grooves 21 of both housings 5 form an accommodation for the fixation member 22. The fixation member 22 is shown in FIG. 7.

Figure 7:
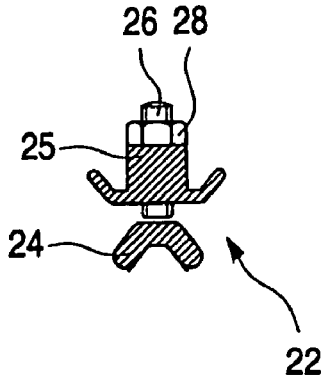
FIG. 7 shows a fixation member.

The fixation member 22 comprises a lower portion 24 and an upper portion 25, both shown in sectional view in FIG. 7. Both portions 24, 25 have a certain length perpendicular with respect to the plane of the drawing. The upper portion 25 comprises one or more through holes with internal screw thread containing bars 26 with external screw thread. The upper end of the bar 26 is provided with a hole for engaging with an Allan key (bar with an hexagonal cross-section), so that the bar 26 can be turned to be moved towards the lower portion 24. It will be clear that the fixation member 22 can seize the grooves 21 of both housings 5. After bar 26 is fastened sufficiently the bar 26 can be secured by fastening nut 28.

Figure 8:
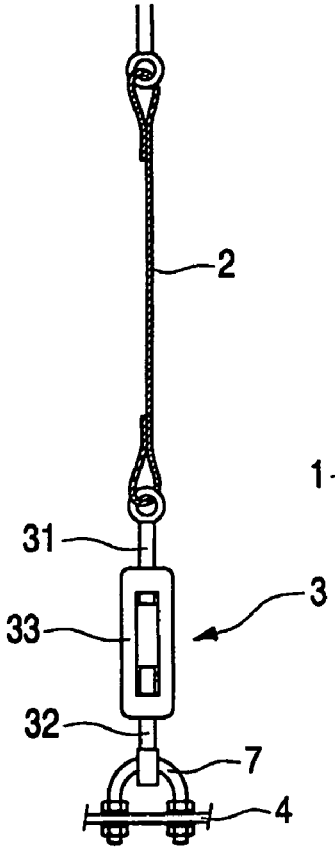
FIG. 8 shows a suspension member.

FIG. 8 shows a suspension member comprising a steel wire 2 and a height adjustable member 3. The steel wire 2 is at its upper end attached to a portion of a building or other construction to which the luminaire 1 is connected. The lower end of the steel wire 2 is connected to the height adjustable member 3 comprising two bars 31,32 and a connector 33. Bar 32 is attached to connecting element 7 at the upper wall 4 of housing 5 of a luminaire 1.

The two bars 31,32 are provided with different external screw thread, left hand thread and right hand screw thread. The connector 3 has corresponding holes with internal screw thread. Therefore, the length of the height adjustable member 3 can be adjusted by turning the connector 33.

Figure 9:
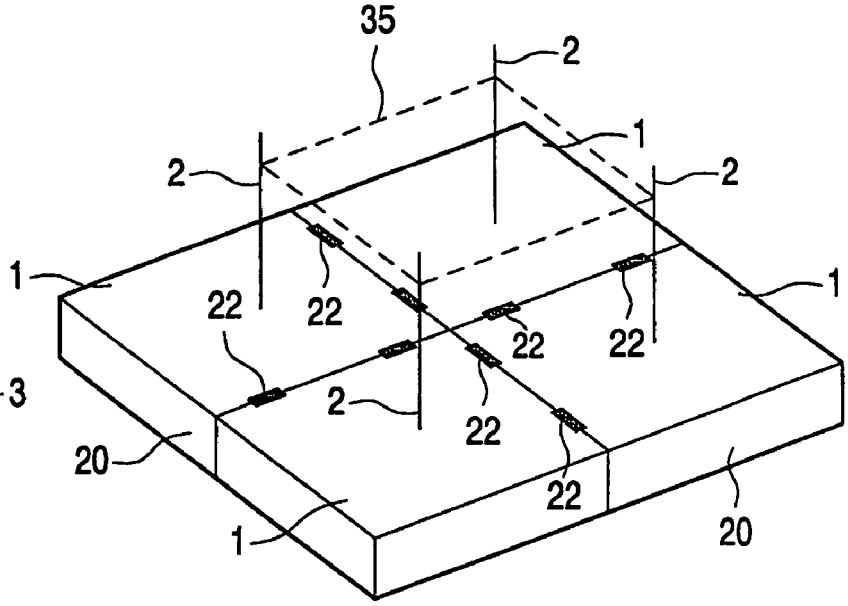
FIG. 9 shows four installed luminaires.

FIG. 9 shows four suspending luminaires 1, each suspended by a steel wire 2 attached to the center of the upper wall of each luminaire 1. The luminaires I have a square shape, seen from below, the sides of the square being about 1.2 meter. Therefore, the four steel wires 2 are also located in the corners of a square in the horizontal plane, as indicated by the dotted line 35.

The housings of the luminaires 1 have four straight vertical side walls 20 (see FIG. 5). The housing of each luminaire 1 is connected to the housings of two adjacent luminaires 1 by fixation members 22—as shown in FIGS. 6 and 7—between said side walls 20. Thereby are two fixation members 22 present—at a distance from each other—between each pair of side walls 20, as is indicated in FIG. 9.

Figure 10:
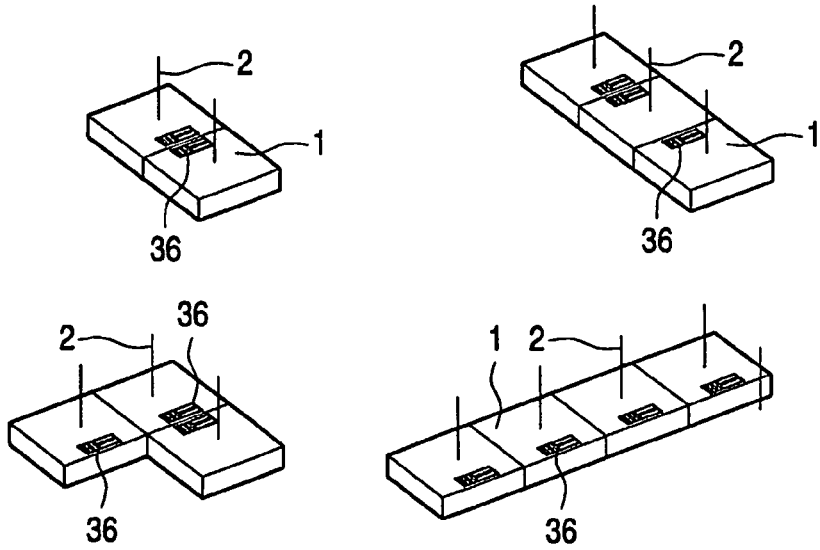
FIG. 10 shows less preferred configurations according to the invention.
Figure 11:
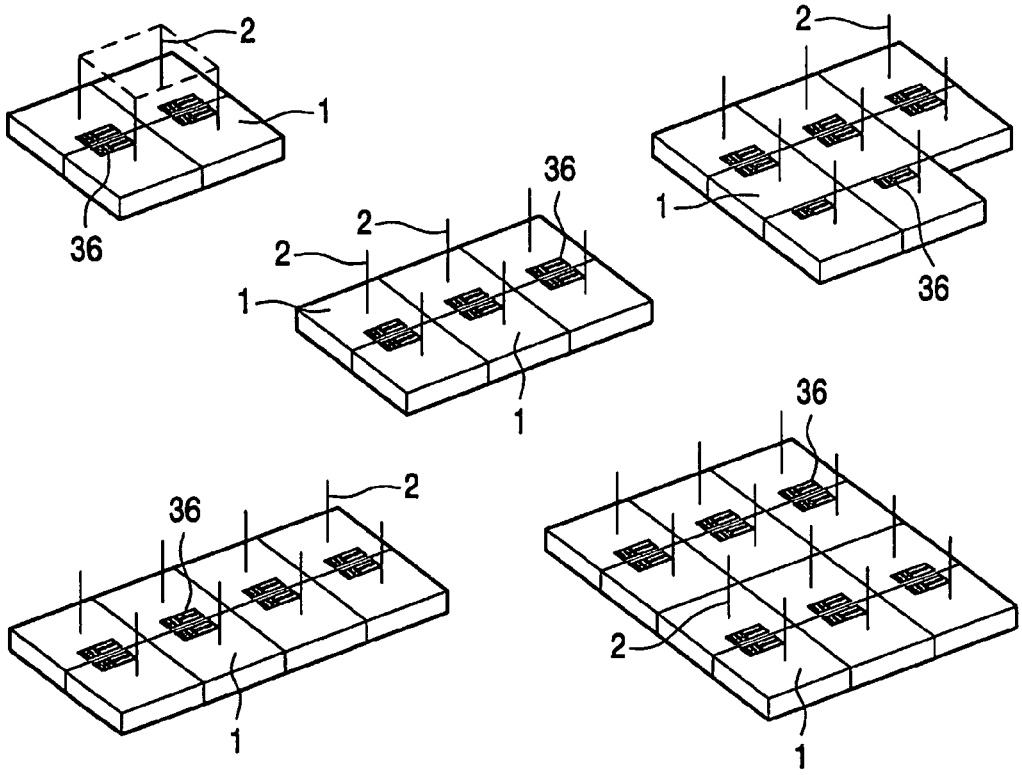
FIG. 11 shows more preferred configurations according to the invention.

The luminaires 1 shown in FIGS. 10-11 are also fixed to each other by two fixation members for each abutting pair of side walls. These luminaires 1 are provided with connection means 36 at the upper wall of the housing of the luminaire. Through these connection means 36 electrical current for the lamps and also control signals can be supplied to the luminaires.

The configurations of the luminaires 1 as shown in FIG. 10 are less preferred, because the suspension of the group of luminaires is less stable then the suspension of the groups as shown in FIG. 11, although all shown configurations have the advantages according to the invention.

The embodiments of the luminaires as described above is merely an example; a great many other embodiments are possible.

The invention claimed is:

1. A system comprising at least two adjacent luminaires, whereby each of said at least two adjacent luminaires is fixed by at least a first fixation member and a second fixation member:

the first fixation member of each of said at least two adjacent luminaires comprising a single suspension member connected to the center of an upper surface of each of said at least two adjacent luminaires for fixation to a ceiling vertically, the first fixation member comprising means for adjusting the height of each of said at least two adjacent luminaires relative to an adjoining one of said at least two adjacent luminaires, and the second fixation member of each of said at least two adjacent luminaires being oriented in a substantially vertical accommodation formed from grooves formed in sidewalls of said at least two adjacent luminaires, said second fixation member including a pair of upper winged protrusions in an upper portion of said second fixation member and a pair of lower winged protrusions in a lower portion of said second fixation member, wherein said upper and lower winged protrusion pairs are configured to vertically clamp respective upper and lower portions of said grooves.

2. The system as claimed in claim 1, wherein a lower side of the at least two adjacent luminaires form a substantially flat surface of a lighting ceiling.

3. The system as claimed in claim 1, wherein each of said at least two adjacent luminaires has at least one substantially vertical straight side wall facing a similar substantially vertical straight side wall of an adjacent luminaire, said side walls being interconnected by said at least one fixation member.

4. The system as claimed in claim 1, wherein said at least two adjacent luminaires are interconnected by the second fixation member located between the at least two adjacent luminaires, said second fixation member comprising portions seizing both of said at least two adjacent luminaires and said fixation member being operable from above the interconnected luminaires.

5. The system as claimed in claim 1, wherein said at least two adjacent luminaires are interconnected by two fixation members at two locations at a distance from each other.

6. The system as claimed in claim 1, wherein four luminaires are interconnected by fixation members, whereby each of the four luminaires is connected to two other luminaires of the said four luminaires.

7. The system as claimed in claim 1, wherein a lower surface of a luminaire comprises a lower wall of a dust-tight box, said dust-tight box further comprising an upper wall at a distance from the lower wall, said box being located inside the housing of the luminaire and underneath the lamp of the luminaire.

8. The system as claimed in claim 7, wherein said box is removable from the housing of the luminaire.

9. The system as claimed in claim 1, wherein the suspension member comprises a wire and/or a height adjustable member.

10. The system as claimed in claim 1, wherein each luminaire comprises a number of tube-like fluorescent lamps being positioned parallel with respect to each other.

11. The system as claimed in claim 1, wherein grooves formed in said pair of adjacent side walls form an accommodation for the second fixation member.

12. The system as claimed in claim 1, wherein said upper portion of said fixation means comprises one or more through holes, each through hole configured to include an internal screw thread and bar having a corresponding external screw thread, said through holes for engaging with a key for adjusting said upper portion relative to said lower portion.

13. The system as claimed in claim 12, wherein said fixation member further comprises securing means for securing said lower and upper portions together subsequent to said adjustment.

14. The system as claimed in claim 13, wherein said securing means is a fastening nut.

15. A ceiling comprising a plurality of adjacent luminaires, whereby each of said plurality of luminaires is fixed by at least a first fixation member and a second fixation member, the first fixation member comprising a single suspension member connected to the center of an upper surface of each of said plurality of luminaires for fixation to a ceiling vertically, the single suspension member comprising means for adjusting the height of each of said plurality of luminaires relative to another of said plurality of luminaires, and the second fixation member of each of said at least two adjacent luminaires being oriented in a substantially vertical accommodation formed from grooves, formed in sidewalls of said at least two adjacent luminaires, said second fixation member including a pair of upper winged protrusions in an upper portion of said second fixation member and a pair of lower winged protrusions in a lower portion of said second fixation member, wherein said upper and lower winged protrusion pairs are configured to vertically clamp respective upper and lower portions of said grooves.

16. A wall comprising a plurality of adjacent luminaires, whereby each of said plurality of luminaires is fixed by at least a first fixation member and a second fixation member, the first fixation member comprising a single suspension member connected to the center of an upper surface of each of said plurality of luminaires for fixation to a ceiling vertically, the single suspension member comprising means for adjusting the height of each of said plurality of luminaires relative to another of said plurality of luminaires, and the second fixation member of each of said at least two adjacent luminaires being oriented in a substantially vertical accommodation formed from grooves formed in sidewalls of said at least two adjacent luminaires, said second fixation member including a pair of upper winged protrusions in an upper portion of said second fixation member and a pair of lower winged protrusions in a lower portion of said second fixation member, wherein said upper and lower winged protrusion pairs are configured to vertically clamp respective upper and lower portions of said grooves.

17. A method for mounting adjacent luminaires to form a light ceiling, whereby each of said adjacent luminaires is fixed by at least a first fixation member and a second fixation member, the method comprising:

suspending each of said adjacent luminaires to the light ceiling vertically by a single first fixation member connected to the center of an upper surface of each of said adjacent luminaires, wherein the first fixation member comprises means for adjusting the height of each of said adjacent luminaires relative to said adjacent luminaires, positioning said second fixation member in a substantially vertically oriented accommodation formed from grooves formed in sidewalls of said adjacent luminaires, and clamping said adjacent luminaires at respective upper and lower portions of said grooves formed in respective adjoining side walls each of said adjacent luminaires via a pair of upper winged protrusions and a pair of lower winged protrusions; and vertically adjusting each of said adjacent luminiares relative to each other via an engagement hole in said upper portion of said second fixation member.

* * * * *